US005988552A

United States Patent [19]

Tisbo et al.

[11] Patent Number: 5,988,552

[45] Date of Patent: Nov. 23, 1999

[54] PORTABLE HOSE REEL CART HAVING A FOLDING HANDLE

[75] Inventors: Thomas A. Tisbo, Barrington Hills; Torrence C. Anderson, Aurora; Brian R. Moon, Dekalb; Michael G. Uffner, Naperville; Michael R. Vogler, Aurora, all of Ill.

[73] Assignee: Suncast Corporation, Batavia, Ill.

[21] Appl. No.: 09/190,680

[22] Filed: Nov. 12, 1998

[51] Int. Cl.[6] ..... B65H 75/40

[52] U.S. Cl. ..... 242/403.1; 242/395; 137/355.26; D8/359; D34/24

[58] Field of Search ..... 242/403.1, 395, 242/395.1; 137/355.26, 355.27; D8/358, 359; D34/24, 26

[56] References Cited

U.S. PATENT DOCUMENTS

| | | | |
|---|---|---|---|
| Re. 32,510 | 9/1987 | Tisbo et al. . | |
| D. 328,173 | 7/1992 | Nelson . | |
| D. 349,039 | 7/1994 | Goodman et al. . | |
| D. 352,149 | 11/1994 | Nelson et al. . | |
| D. 363,207 | 10/1995 | Tisbo et al. . | |
| 2,755,035 | 7/1956 | Moulder . | |
| 4,506,698 | 3/1985 | Garcia et al. . | |
| 4,700,737 | 10/1987 | Nelson . | |
| 4,768,546 | 9/1988 | Brusadin et al. . | |
| 4,777,976 | 10/1988 | Johnston et al. . | |
| 4,913,580 | 4/1990 | Whitehead . | |
| 5,007,598 | 4/1991 | Spear et al. . | |
| 5,046,520 | 9/1991 | Sanchez, Jr. et al. . | |
| 5,056,553 | 10/1991 | Whitehead et al. | 137/355.27 |
| 5,425,391 | 6/1995 | Tisbo et al. . | |
| 5,758,685 | 6/1998 | Tisbo et al. . | |
| 5,794,649 | 8/1998 | Spear et al. | 137/355.27 |

FOREIGN PATENT DOCUMENTS

| | | | |
|---|---|---|---|
| 2415596 | 1/1978 | France . | |
| 2679890 | 2/1993 | France | 242/403.1 |

*Primary Examiner*—Donald P. Walsh
*Assistant Examiner*—Emmanuel M. Marcelo
*Attorney, Agent, or Firm*—Welsh & Katz, Ltd.

[57] ABSTRACT

A portable hose reel cart has a folding handle that is pivotable between an in-use position and a storage position. The cart includes a pair of spaced apart side frames members having a base portion. A rotatable spool is positioned between the side frames and is operably connected thereto for rotation of the spool about an axis of rotation. A folding handle assembly has a pair of spaced apart mounting arms and a gripping portion extending between the mounting arms. Each of the mounting arms is associated with a respective one of the side frame members and the spool is positioned intermediate the mounting arms. The mounting arms are lockable in the handle in-use position by latches that engage their respective side frames. A pair of wheels is mounted to the cart at the base, generally vertically below the handle gripping portion, when the handle assembly is in the in-use position. The wheels are mounted to the cart independently of one another by hubs that extend from the respective side frames and insert into the wheels.

13 Claims, 8 Drawing Sheets

PORTABLE HOSE REEL CART HAVING A FOLDING HANDLE

FIELD OF THE INVENTION

This invention pertains to carts for the storage of hoses, such as common garden hoses. More particularly, the invention pertains to portable, storable, hose reel carts that include wheels for easy transport and folding or fold-away handles for storage.

BACKGROUND OF THE INVENTION

Portable hose reel carts have become quite popular and are commonly recognized household items for lawn and garden care. Such carts permit conveniently storing and handling lengths of flexible hose. Typically, hose reel carts are constructed from molded plastic components and include a central spool that rotates to pick-up and pay-out the flexible hose.

While the construction of such hose carts is quite varied, in a typical application, the spool is supported on either side by a frame that permits rotation of the spool. Many carts include a pair of wheels so that the cart can be tilted for readily transported from one location to another. Typically, the cart includes a handle that extends upward, above the spool, generally above the wheels, to facilitate moving the cart.

Hose reel carts can be constructed of many materials. However, it has been found that molded plastic or polymeric materials best meet requirements for light-weight, durability, strength and corrosion resistance. Carts made of such materials must also be designed taking into consideration the abuse that such a cart may be subjected to over its lifetime. For example, those living in northern climates recognize that carts may often be stored outdoors for the winter months. To this end, carts must be constructed of materials that withstand cold temperatures without becoming brittle or warping, and without metal parts corroding. Likewise, those living in southern climates recognize the need for the cart to be able to withstand higher temperatures and exposure to direct sunlight, also without becoming brittle or warping.

An additional factor that must be taken into consideration in the design of such hose reel carts, is the ability to store the cart with hoses stored on the spool. That is, space and storage requirements are a concern for most, if not all, homeowners. To this end, cart designs include provisions for rotating or folding-away the cart handle so as to reduce the storage space necessary to store the hose-laden cart. In known designs, however, the handle lock/release mechanism, which is subjected to constant use and wear, is typically exposed and can become clogged with dirt or other debris or can break due to use.

In order to assure proper functioning of the cart when the handle is extended into the transport or in-use position, the mechanism by which the handle is released and locked into the use position must be configured to prevent debris and foreign objects from becoming lodged therein. Moreover, such locking mechanisms must be configured for ready access by the user, and for maximum isolation from the environment.

As discussed above, typically such carts also include wheels for moving the cart from one location to another. In a typical arrangement, the wheels are connected to one another by a steel axle that extends through the side frames. Because of the environments to which a hose reel cart may be subjected; e.g., varying temperatures, wet and/or dirt laden areas, and the stresses to which they are subjected in use, common steel axles have been observed to corrode, bend or break and thus fail.

Accordingly, there exists a need for a hose reel cart that provides ready portability for use of the hoses stored thereon. Desirably, such a cart includes a fold-away handle that includes a locking/release mechanism that is readily accessible by a user, and is isolated from the environments to which the cart may be subjected. Such a cart includes wheels that are mounted thereto, independent of one another, without the use of a steel, or like corrosion susceptible axle.

SUMMARY OF THE INVENTION

A portable hose reel cart includes a folding handle pivotable between an in-use position and a storage position. The cart includes a pair of spaced apart side frames members, each frame member having a base portion. A rotatable spool is positioned between the side frames and is operably connected thereto for rotation of the spool about an axis of rotation.

The folding handle assembly has a pair of spaced apart mounting arms and a gripping portion extending between the mounting arms. Each of the mounting arms is associated with a respective one of the side frame members. The spool is positioned intermediate the mounting arms. The handle assembly is pivotable relative to the side frame members between a storage position wherein the handle is rotated so that the gripping portion lies adjacent the base portions and an in-use position wherein the gripping portion is rotated away from the base portions and is spaced therefrom.

A lock assembly is positioned in each of the handle assembly mounting arms. Each lock assembly includes a latch received in the mounting arm. Each latch includes a locking projection that is moveable between an engaged position wherein the projections engage their respective side frames and a disengaged position wherein the projections are disengaged from their respective side frames. Preferably, the projections engaged their respective side frames to lock the handle into the in-use position. Most preferably, the latches each include a biasing element formed integral therewith to bias the projections into the engaged position.

In a preferred embodiment, the side frames include inwardly extending stubs and the mounting arms include open collar portion for receiving the stubs so that the handle assembly pivots relative to the side frames. The latches are positioned within the mounting arms so that the locking projections extend through the mounting arms and into the side frames to lock the handle assembly into the in-use position. Preferably, the latches each include a release button that extends through an opening in an outer wall of its respective mounting arm to release the latch from the locked position and to permit rotation of the handle to the storage position.

The cart includes wheels mounted thereto at the base portion, generally vertically below the handle gripping portion when the handle assembly is in the in-use position. Preferably the side frames each include an outwardly extending hub that is adapted to receive a wheel. The wheels are secured to the cart by a wheel locking member. The locking member has a plate and a stub extending from the plate. The stub is received in the hub so that the plate abuts the wheel to secure the wheel to the side frame.

Other features and advantages of the present invention will be apparent from the following detailed description, the accompanying drawings and the appended claims.

DETAILED DESCRIPTION OF THE PREFERRED EMBODIMENTS

Figure 1:
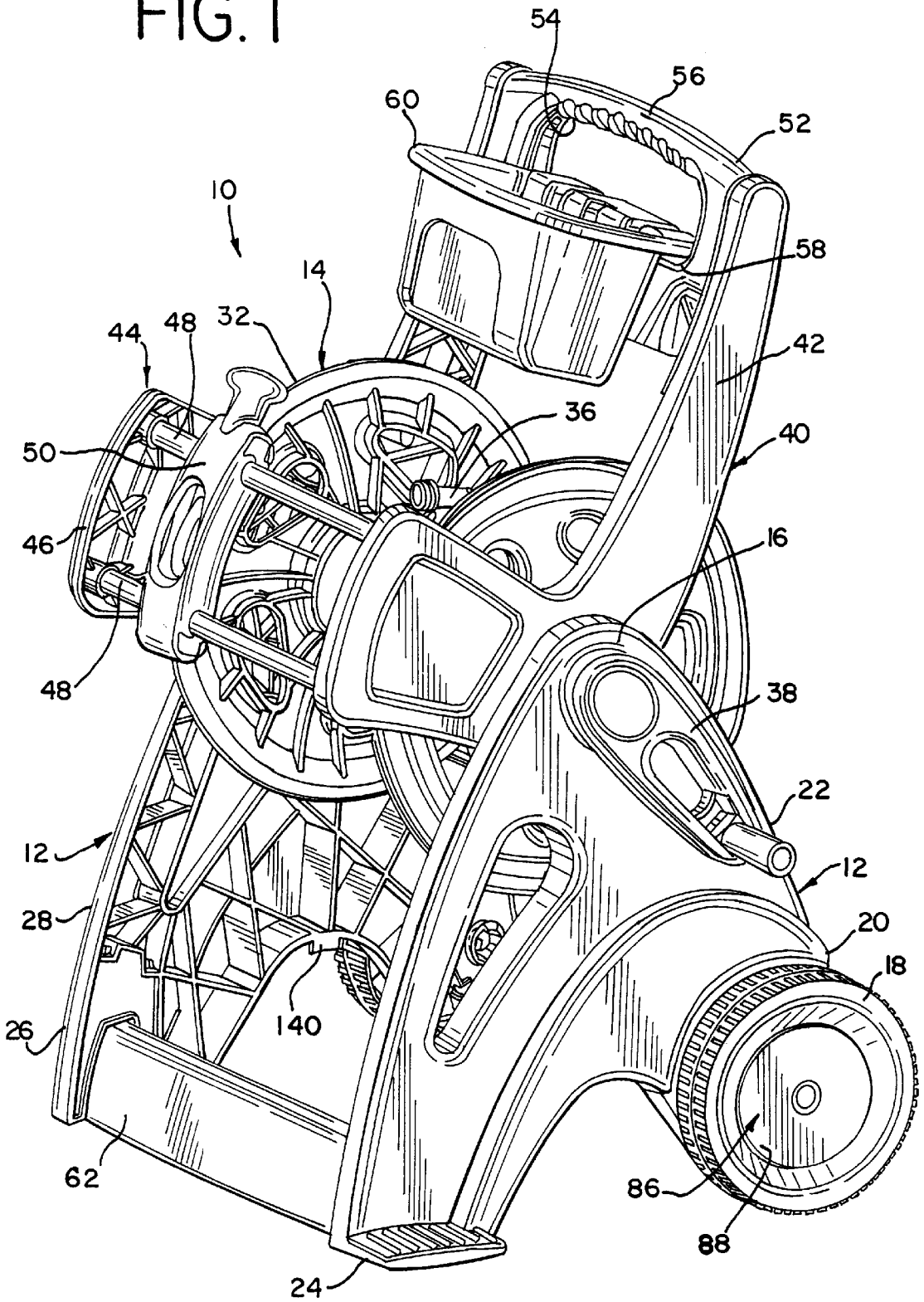
FIG. 1 is a front perspective view of a portable hose reel cart having a folding handle embodying the principles of the present invention, the cart being illustrated with an optional handle-mounted storage bin.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring now to the figures, and generally to FIGS. 1–5, there is shown one embodiment of a hose reel cart 10 embodying the principles of the present invention. The hose reel cart 10 provides a storage apparatus for storing flexible hose, while at the same time, permitting ready transport of the hose. The cart further provides a "base-station" when coupled to a water outlet; e.g., an outside faucet or water spigot, so that an operator can pay-out as much hose as needed while one end of the hose remains coupled in fluid communication with the water supply.

The cart includes a pair of side frames 12 that have a generally "A" or triangular shape. The side frames 12 support a spool assembly 14 at about the top or apex 16 of the frame 12. The spool 14 is rotatable and provides for pick-up, storage and pay-out of the hose. The cart 10 includes wheels 18 at the bottom 20 of the one of the legs 22 of the A-shaped frame 12 and a foot or rest 24 at the bottom 26 of at least one of the other of the frame legs 28.

The spool 14 includes a central hub 30 and a pair of radially extending flanges 32 that are configured to accommodate a length of flexible hose wrapped around the hub 30 between the flanges 32. In a typical arrangement, the cart 10 can store about 200 to 300 feet of common ⅝ inch garden hose. Those skilled in the art will recognize that the cart 10 includes a water inlet port or in-tube 34 and an outlet port or out-tube 36. Typically the in-tube 34 is mounted to the frame 12 at about the axis of rotation A of the spool 14. The in-tube 34 is connected to the out-tube 36 by a sliding seal arrangement (not shown) so that the in-tube 34 remains fixed to the frame 12, while the out-tube 36 rotates with the spool 14, and the in-tube 34 and out-tube 36 remain in fluid communication with one another. This arrangement permits rotation of the spool 14 without twisting or torquing internal components, while maintaining sealed fluid communication between the water supply and the hose. Typically, a crank 38 is connected to the spool 14 to facilitate pick-up of the hose.

Figure 14:
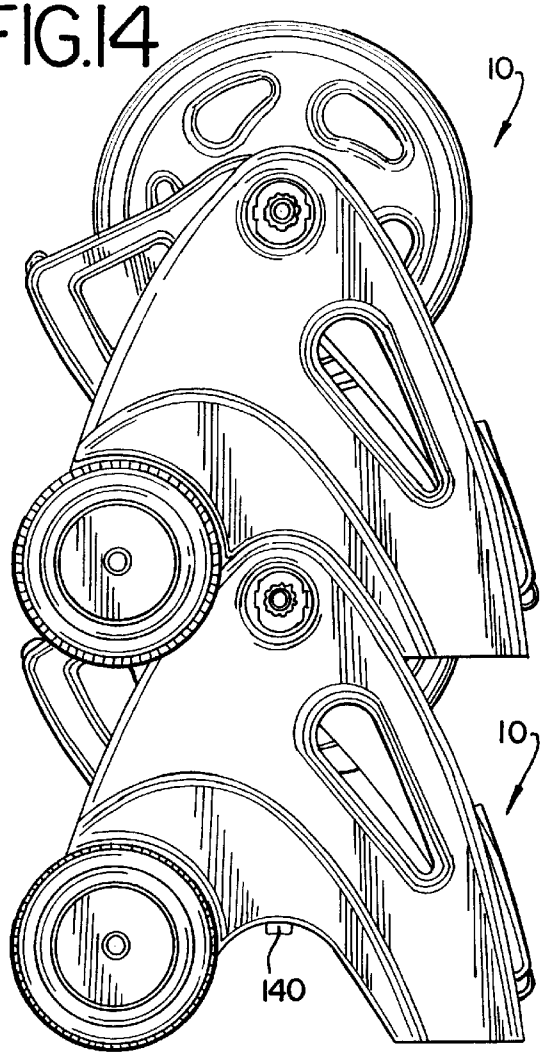
FIG. 14 illustrates two carts stacked and nested with one another, with the cart handles in the folded position.
Figure 12:
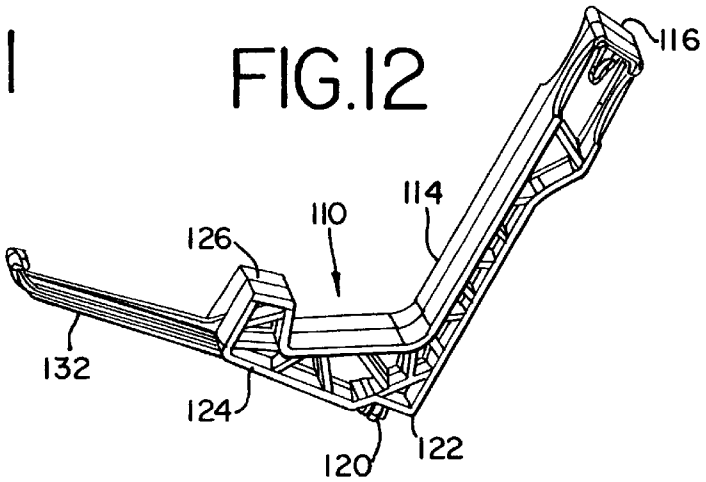
FIG. 12 is a front perspective view of the lock assembly latch.
Figure 13:
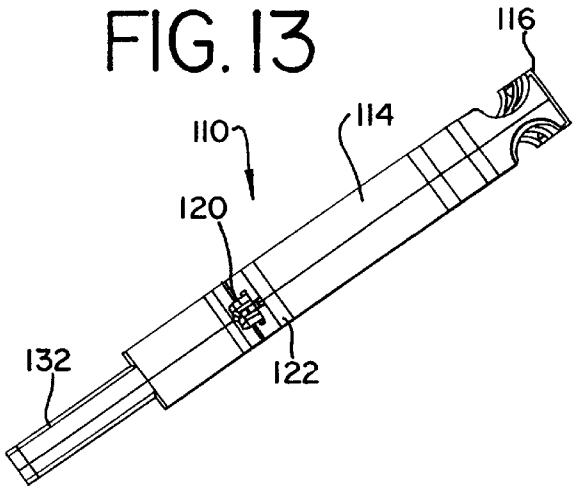
FIG. 13 is a rear view of the latch of FIG. 12.

A folding handle assembly 40 extends from the cart 10 and includes a pair of arms 42 that are pivotally mounted to the cart 10 intermediate the spool flanges 32 and their respective frame 12 connections. In this manner, the cart handle 40 pivots essentially co-axially with the spool 14. That is, the cart handle 40 pivots about the axis of rotation A of the spool 14. The handle 40 is pivotal between a storage position, as illustrated in FIG. 14, and an in-use position as shown in FIG. 1. Optionally, as shown in FIGS. 1–5, the cart 10 can include a guide assembly 44 to guide the hose as it is picked-up onto the spool 14 to distribute the hose evenly across the spool 14. In one embodiment, the guide assembly 44 includes a pair of guide support arms 46 integral with the handle assembly 40 that extend generally transverse to the handle assembly arms 42. A pair of guide rails 48 extend between the support arms 46. A guide 50 is slidably movable along the rails 48 to facilitate even distribution of the hose onto the spool 14.

Figure 3:
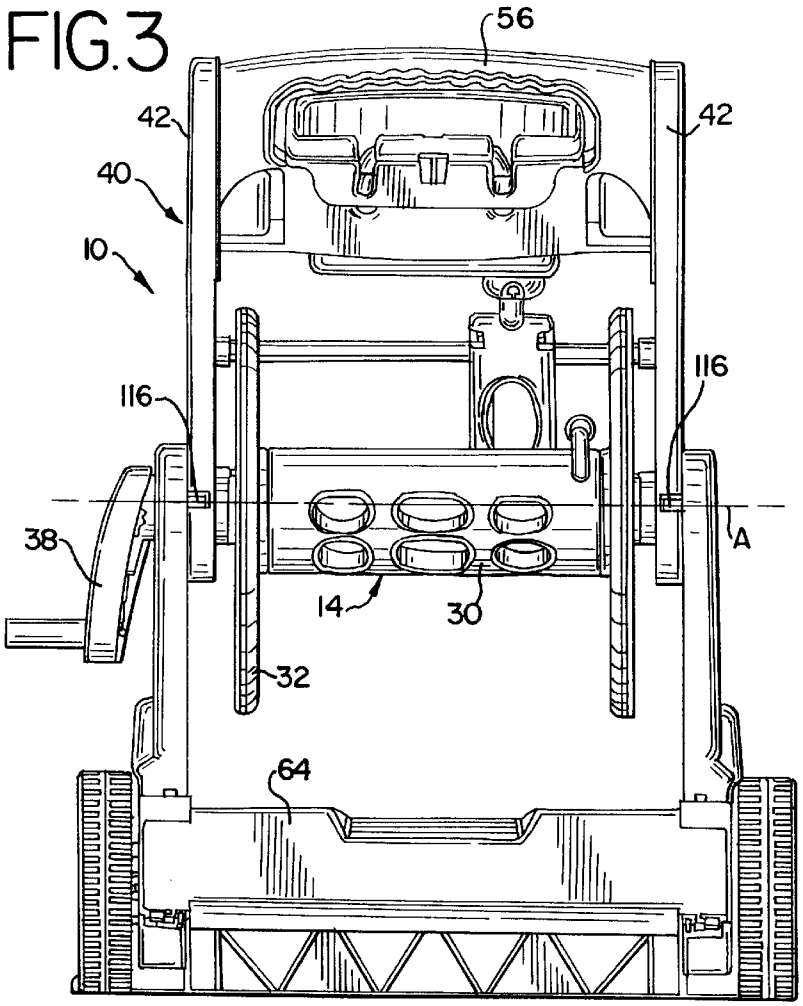
FIG. 3 is a rear view of the cart of FIG. 1.
Figure 2:
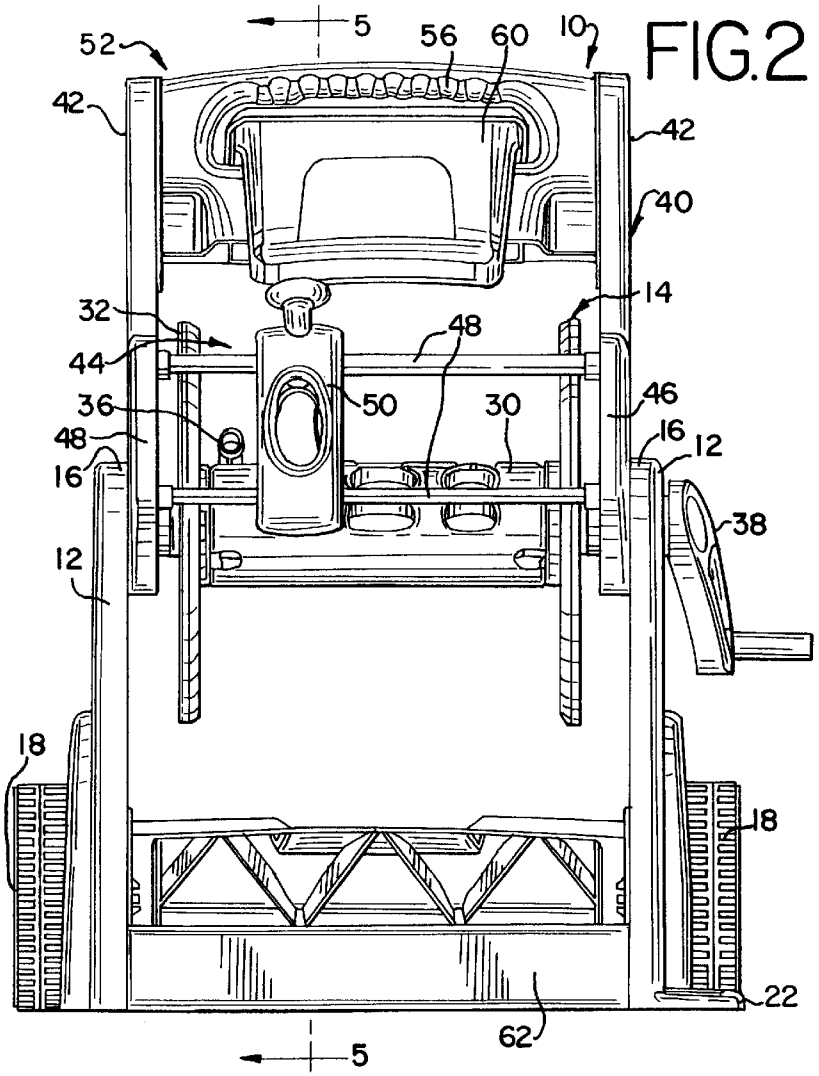
FIG. 2 is a front view of the cart of FIG. 1.
Figure 5:
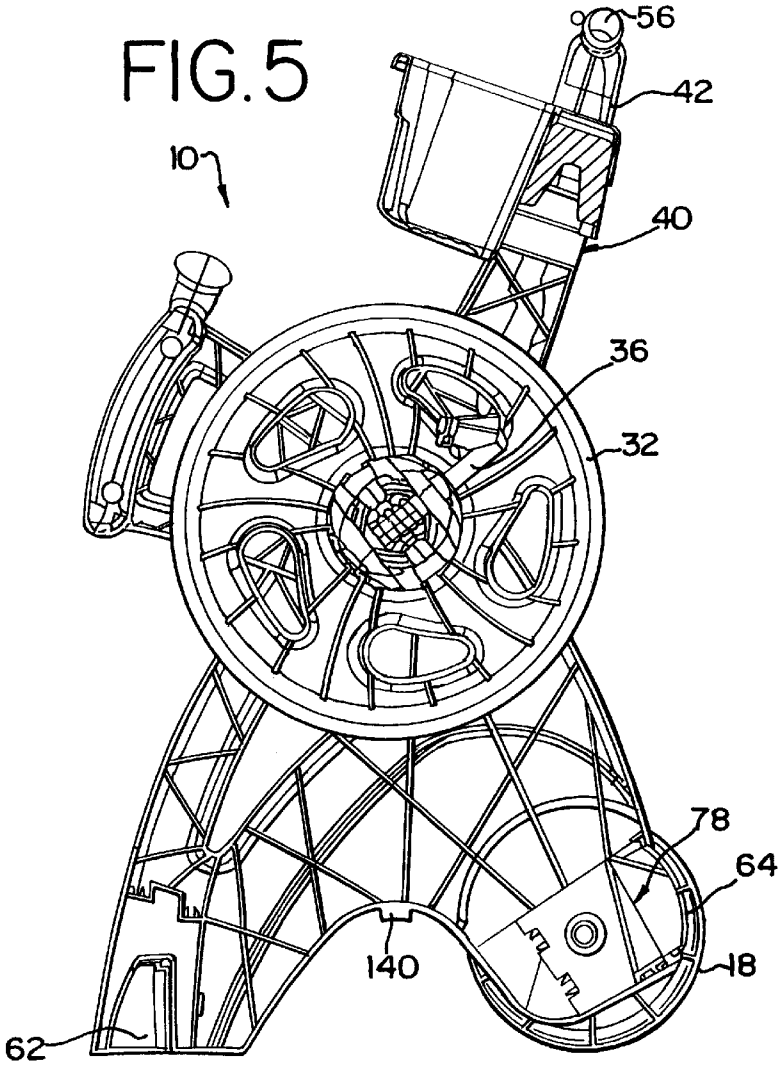
FIG. 5 is a partial cross-sectional view of the cart of FIG. 1, taken along line 5—5 of FIG. 2.
Figure 4:
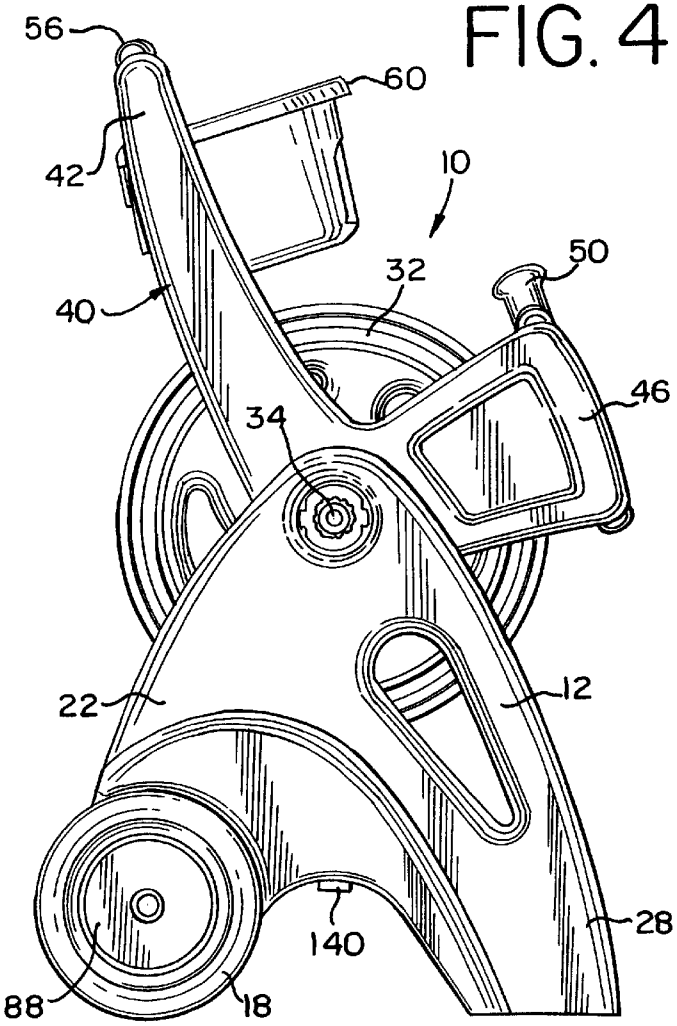
FIG. 4 is a side view of the cart of FIG. 1, as seen from the left hand side thereof.

Referring now to FIGS. 1–3, the handle assembly 40 includes a gripping portion 52 that extends between the arms 42. The gripping portion 52 defines an opening 54 and an upper portion or grip 56 for grasping the handle assembly 40. In the illustrated embodiment, the handle assembly 40 includes a lower portion 58 that is configured to accommodate, for example, a storage bin 60. The storage bin 60 can be used to store various hose attachments, such as, spray heads, nozzles and the like. Consumers will recognize the advantage to having the handy storage bin 60 mounted to the cart 10, so that hose attachments can be readily stored with the hose and easily accessed, rather than stored in another location and possibly misplaced or lost.

In order to provide additional rigidity to the cart 10, a front lateral support beam 62 extends between and connects the bottom front frame legs 28 at about the foot 24. The front beam 62 can be integral with the side frames 12, or can be connected thereto by methods that will be recognized by those skilled in the art. The front beam 62 increases the structural integrity of the cart 10 overall by preventing the side frames 12 from bowing or bending, inwardly or outwardly, relative to one another and thus, adversely affecting the operation of the handle assembly 40 or the rotation of the spool 14.

Figure 6:
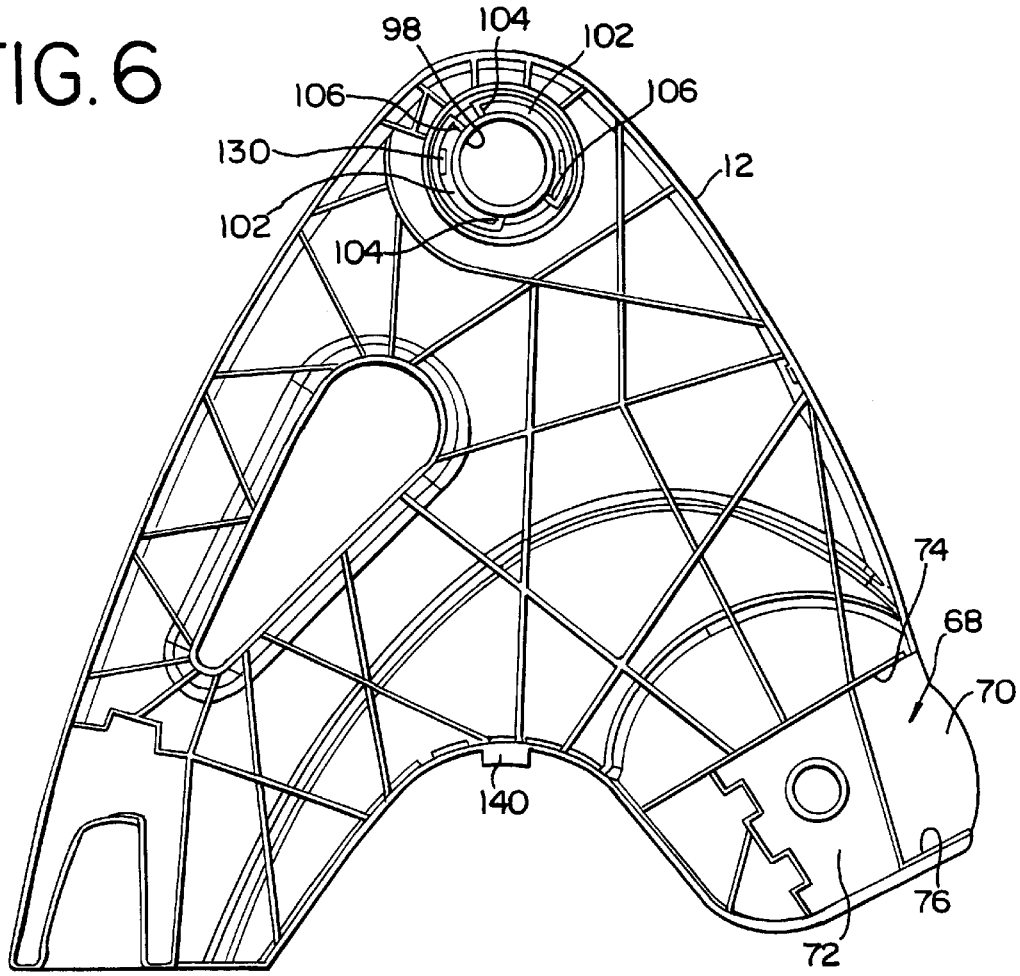
FIG. 6 is a view of one of the A-shaped side frames of the cart, as seen from the center of the cart viewed outward.
Figure 7:
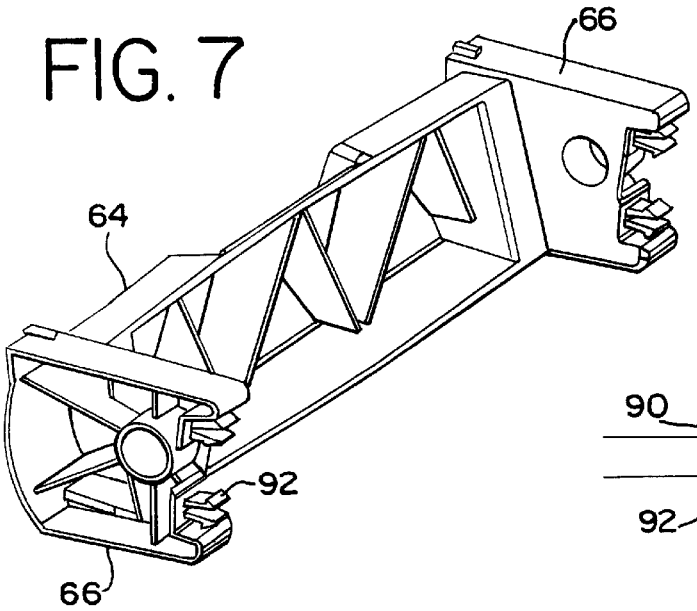
FIG. 7 is a perspective view of a rear lateral support beam.
Figure 8:
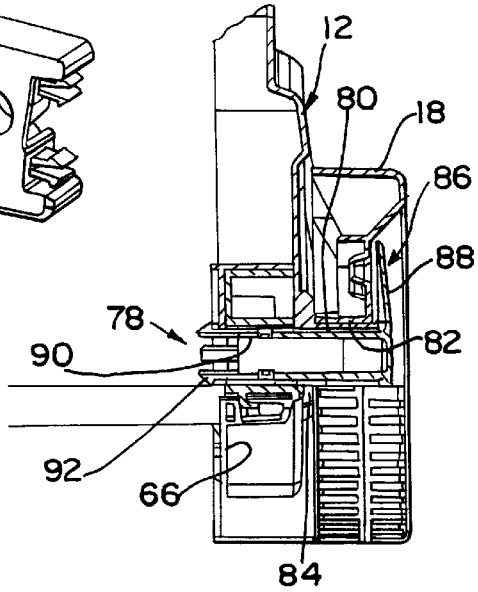
FIG. 8 is a partial cross-sectional view of a wheel and wheel support assembly.

Referring now to FIGS. 3 and 6–7, the illustrated embodiment of the cart 10 includes a rear lateral support beam 64 that extends between and connects the side frames 12 at about the wheels 18. The rear beam 64 is positioned rearward and off-center of the axis of rotation of the wheels 18. In this manner, the rear support beam 64 provides a foot rest, essentially independent of any wheel 18 rotation device or mechanism, for securing the cart 10 while pulling rearward on the handle 40 to tilt the cart 10 for movement.

In a preferred arrangement, the rear support beam 64 includes a locking projection 66, similar to a tenon, at each end of the beam 64, and the side frames 12 each include a channel 68, similar to a mortise, configured to receive a respective locking projection 66. The channels 68 each are defined by an outer wall 70, a partial inner wall 72, and upper and lower walls 74, 76. The outer wall 70 is formed as part of the outer side wall of the side frame 12 and the inner wall 72 is partially formed to that the rear beam 64 is recessed into the frame 12.

Referring now to FIGS. 5–8, there is shown the wheel support assembly 78, which is defined in part, by the channel inner and outer walls 72, 70, and the locking projection 66. Each wheel support assembly 78 secures a wheel 18 to the cart 10. The side frames 12 each include an outwardly extending tubular-like projection or hub 80, that is configured for receipt in a central opening 82 formed in the wheel 18. In this manner, support for each wheel 18 is independent of support for the other wheel 18, and is provided by the side frames 12, rather than an axle that extends across or traverses the rear portion of the cart. The hub 80 can include gussets 84 extending between the hub 80 and the outer wall of the side frame 12 to provide additional structural rigidity to the wheel support assembly 78.

The wheel support assembly 78 includes a locking plate 86 having a wheel plate 88 and a stub 90 extending from the plate 88. The stub 90 is configured for insertion through the central opening 82 of the wheel 18. The plate 88 abuts the wheel 18 as the stub 90 extends through the wheel opening 82 and hub 80, through the outer and inner walls 70, 72 of the frame channel 68, and through the locking projection 66 (e.g.; through the "mortise and tenon"). In this manner, the stub 80 essentially locks the rear support beam 64 and the wheels 18 to the side frames 12. Detent or snap-type fasteners, such as those illustrated at 92, can be used to secure the stub 90 to the inner wall 72. Those skilled in the art will appreciate that the snap-type fasteners 92 can be used throughout the cart 10 to mount or secure components to one another, and to facilitate ready assembly of the cart 10 if it is provided in an unassembled manner.

It will be apparent from the figures that this arrangement provides exceptional structural support for mounting the wheels 18 to the cart 10, and provides a secure arrangement that independently locks each wheel 18 to the cart 10. In addition, as is apparent from the drawings, the elimination of a transversely extending axle reduces the opportunity for a consumer to use to the axle for leverage, such as using the axle as a foot rest, for tilting the cart back onto the wheels for transport. Consumers that have used such wheeled devices will recognize that one common failure point of known carts is the axle, and that the wheels will often separate from the device or the axle will break or bend, thus rendering the device inoperable or unusable. The present arrangement overcomes these problems of known carts by providing a positive wheel-lock arrangement that has independent wheel support structures 78 that are not connected by a common axle.

Figure 11:
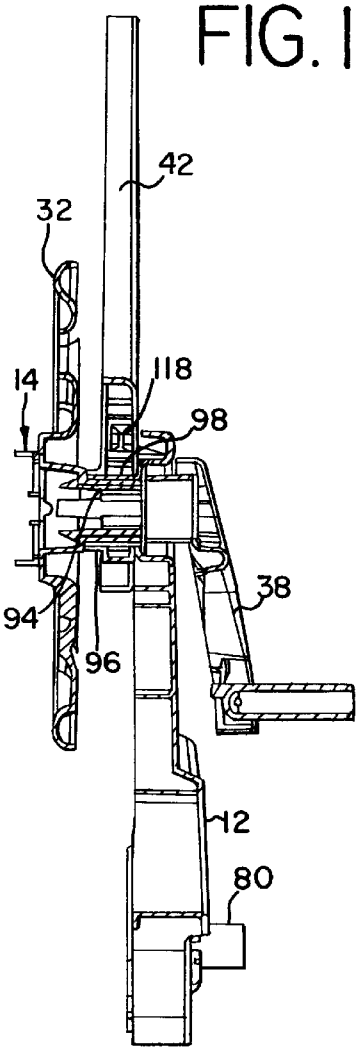
FIG. 11 is a partial cross-sectional view of the cart illustrating a spool flange, crank, handle mounting arm and side frame.
Figure 16:
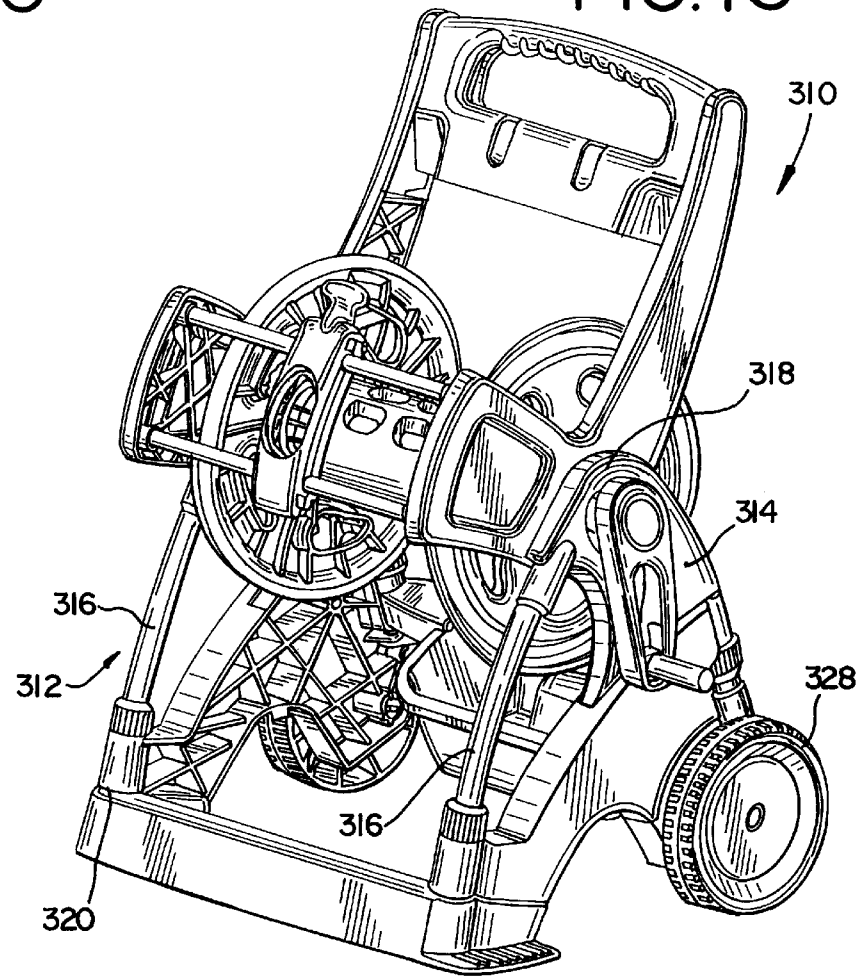
FIG. 16 is a front perspective view of still another alternate embodiment of the cart.

Referring now to FIGS. 1 and 11 the crank 38 is operably connected to the spool 14 so that rotation of the crank 38 in turn rotates the spool 14 to pick-up the hose for storage on the spool 14. The crank 38 extends through the side frame 12 and the handle assembly 40, and mounts to a stub portion 94 extending from one of the spool flanges 32. At the opposing side of the cart 10 is the in-tube 34 (see FIG. 4) which provides a fluid connection for the 10 cart from the water source.

Figure 9:
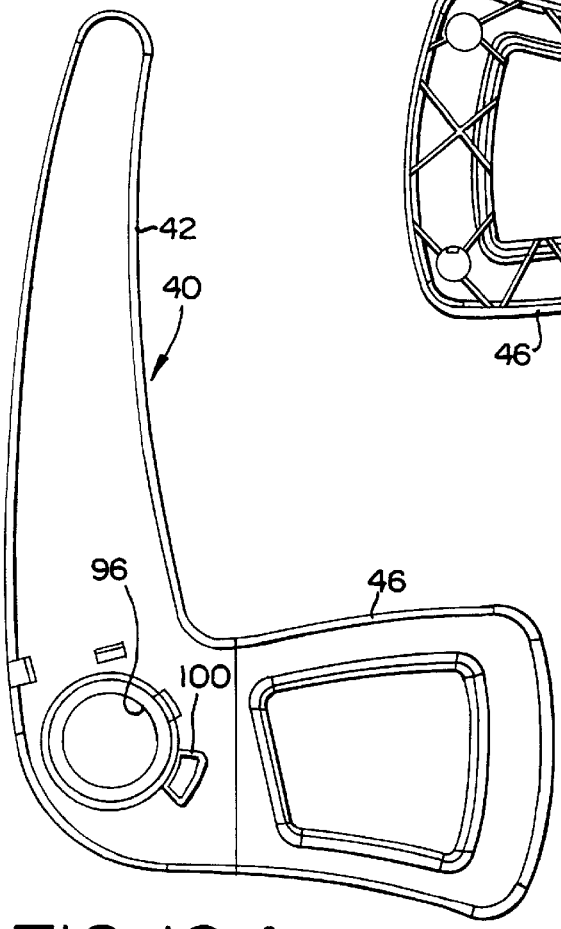
FIG. 9 is a view of the handle mounting arm, as viewed looking into the cart.
Figure 10:
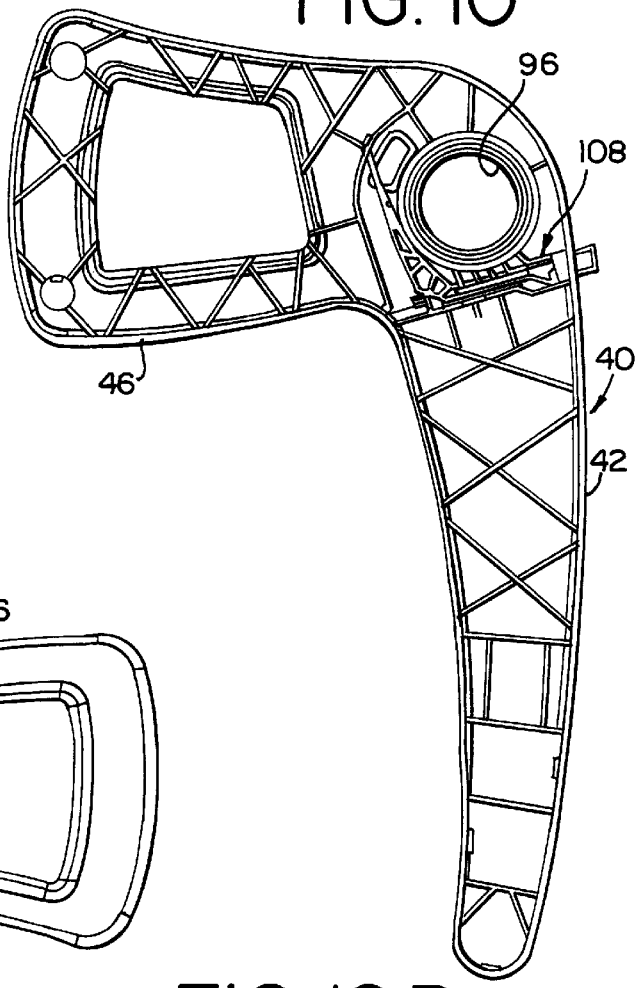
FIG. 10 is a view of the rear side of the mounting arm of FIG. 9, illustrating the handle lock assembly in the locked position.
Figure 10A:
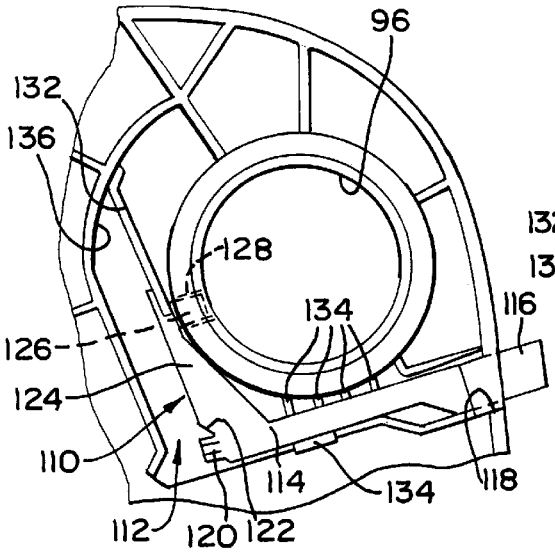
FIGS. 10A and 10B are partial, enlarged views of the handle lock assembly illustrating the lock assembly in the locked position in FIG. 10A and in the unlocked position in FIG. 10B.
Figure 10B:
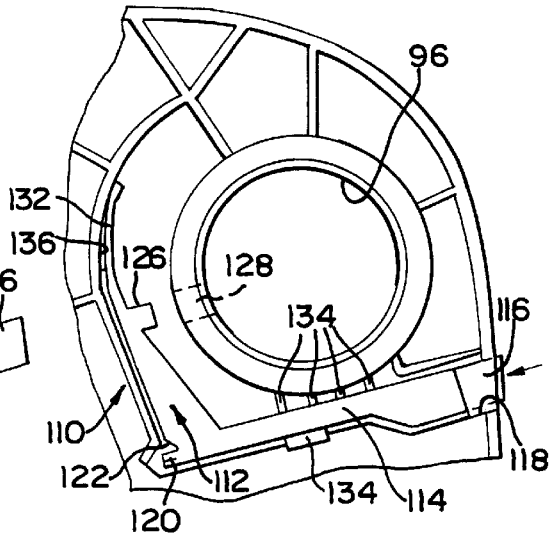

Referring now to FIGS. 9–11, the handle assembly 40 includes an open circular collar portion 96 that defines the pivot for the assembly 40. A short connecting stub 98 extends from each side frame 12 and inserts into the collar 96 to provide a pivot about which the handle 40 assembly rotates. A pivot stop 100 extends outwardly from the handle assembly 40 into an arcuate channel 102 formed in the side frame 12 (see FIG. 6). The channel 102 defines the travel path and the length of travel or rotation of the handle assembly 40 as it pivots between the in-use and storage positions.

In the storage position, the pivot stop 100 engages a first inner wall 104 of the channel 102 to prevent over rotation of the handle assembly 40 beyond the storage position. In the storage position, the handle assembly 40 rotates downwardly so that the hand grip 56 folds against the front beam 62 of the cart 10, and is essentially contained within the outline or profile of the side frame 12. In the in-use position, the stop 100 engages a second inner wall 106 of the channel 102 to prevent over rotation of the handle 40 beyond the in-use position. When the handle assembly 40 is rotated upward into the in-use position, it extends upwardly to a generally vertical position, above the rear support beam 64.

As best seen in FIGS. 10–13, a lock assembly 108 is positioned within each of the handle assembly side arms 42 to lock the handle assembly 40 into the in-use position. The lock assembly 108 includes a latch 110 that is fitted into a latch receiving region 112 in each of the arms 42. The latch 110 includes a generally "L-shaped" body 114 having a latch release button 116 at one end of the body 114. The release button 116 extends through an opening 118 in the handle arm 42 for ready user access. Advantageously, the button 116 is located so that when the handle 40 is in the in-use position, the release button 116 is oriented downwardly and rearwardly toward the user so that the button 116 can be readily accessed, is minimally subjected to the environs, and is "out-of-the-way" to reduce the opportunity for being inadvertently struck.

The latch 110 includes a stop element 120 positioned at about the heel 122 of the L-shaped body 114. The stop element 120 prevents over-insertion of the release button 116, and thus prevents over-travel of the latch 110, when the button 116 is depressed to release the handle 40 from the in-use position.

Spaced from the button 116, and positioned on an opposing leg 124 of the body 114 near the heel 122, the latch 110 includes a finger-like locking projection 126. The finger 126 extends through an opening 128 in the collar 96 and a complementary, opening 130 in the side frame connecting stub 98. The openings 128, 130 are aligned with one another when the handle 40 is in the in-use position. In this manner, when the handle 40 is in this position, the locking finger 126 extends through the openings 128, 130 to lock the handle 40 and side frame 12 relative to one another.

A biasing leg 132 extends from the latch body 114, adjacent to the locking finger 126 in opposing relation to the release button 116. The biasing leg 132 biases the locking finger 126 into the locked position, or that position in which the locking finger 126 projects through the openings 128, 130. In this manner, when the handle 40 is rotated to the in-use position, the finger 126 is biased into the openings 128, 130, by the biasing leg 132, to provide a positive lock of the handle 40 into the in-use position. Advantageously, in this arrangement, a positive user action is necessary (that is, depression of the release button 118 inward of the arm 42) to release the handle 40 for rotation into the storage position.

The latch receiving region 112 is fully formed in the handle side arm 42 to provide a substantially isolated enclosure for the latch 110. As will be appreciated by those skilled in the art, although the release button 116 is user-accessible, the other latch 110 portions are maintained generally isolated from the environs. This arrangement greatly reduces the opportunity for, or prevents debris and the like from obstructing movement of the latch 110, and preventing proper operation of the handle lock assembly 108. The latch receiving region 112 includes guides 134 to maintain proper alignment of the latch 110 within the region 112, and includes a wall 136 for engagement by the latch biasing leg 132.

To release the handle 40 for rotation into the storage position, the release button 116 is depressed, which in turn urges the locking finger 126 out of engagement with the collar and projection openings 128, 130. With the locking finger 126 removed from the openings 128, 130, the handle 40 can be pivoted or rotated from the in-use position to the storage position. As discussed previously, when the handle 40 is in the storage position, it essentially resides within the profile of the side frame 12. In this manner, the cart 10 can be stacked with other like carts, nesting in the manner as illustrated in FIG. 14. This provides advantages for shipping, storing and merchandising a plurality of carts which will be appreciated by those skilled in the art. A nesting guide 140 facilitates neat and orderly nesting and stacking of the carts 10 with one another.

Figure 15:
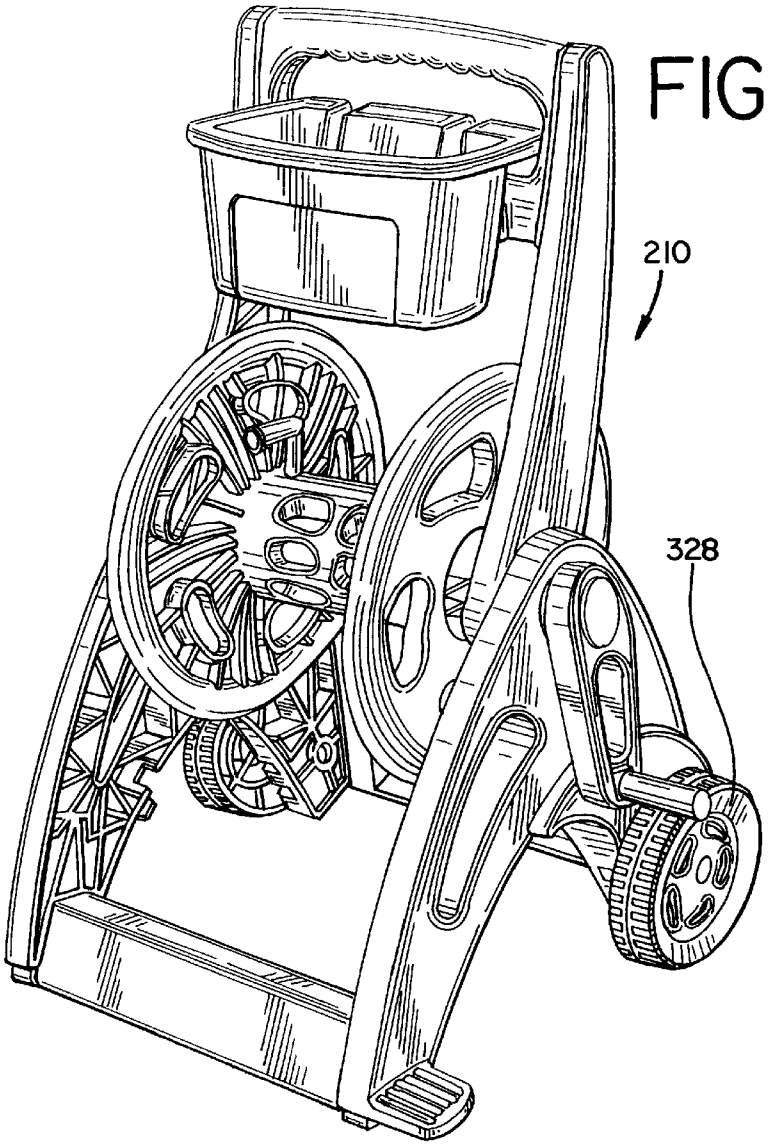
FIG. 15 is a front perspective view of an alternate embodiment of the cart.
Figure 18:
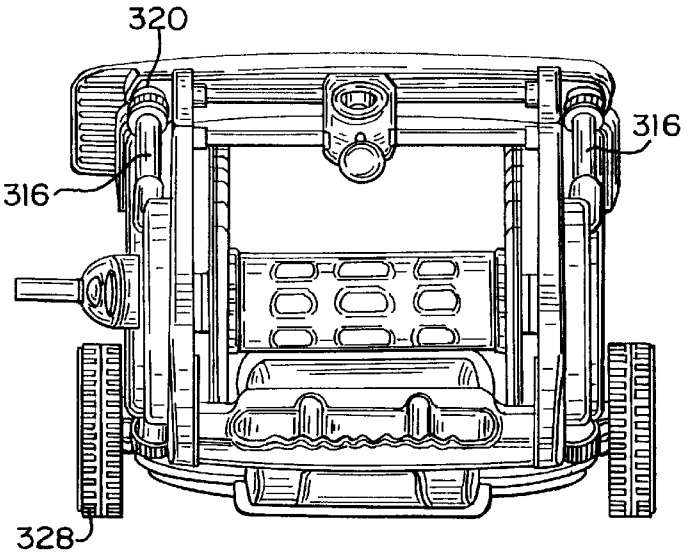
FIG. 18 is a top view of the cart of FIG. 16.
Figure 19:
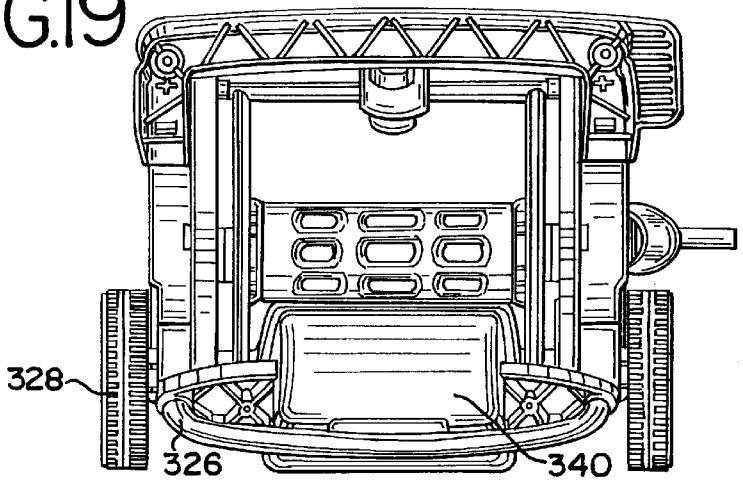
FIG. 19 is a bottom view of the cart of FIG. 16.

One alternate embodiment of the cart 210 is illustrated in FIG. 15. This "smaller" embodiment of the cart 210 does not utilize a hose guide. Rather, the hose is manually distributed along the length of the spool 212 during pick-up. This embodiment of the cart 210 includes the handle lock assembly and the wheel securing arrangement of the embodiment of the cart 10 illustrated in FIG. 1.

Still another alternate embodiment of the hose reel cart 310 is illustrated in FIGS. 16–19. In this embodiment, the front portion 312 of the side frames 314 each include a front steel support member 316 extending from about the apex 318 of the frame 314 to the front of the base 320. The steel member 316 which is used in this embodiment in lieu of a fully molded side frame, is preferably formed as a tubular steel member 322 having a plastic coating 324 (see FIG. 20). The plastic coating 324 reduces the opportunity for corrosion of the steel member 322 and provides structural rigidity to the cart 310.

Figure 20:
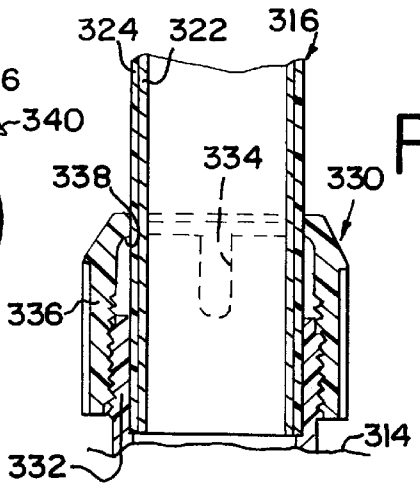
FIG. 20 is a partial cross-sectional view of a compression coupling for the cart of FIG. 16 for securing tubular members to the cart side frames.
Figure 17:
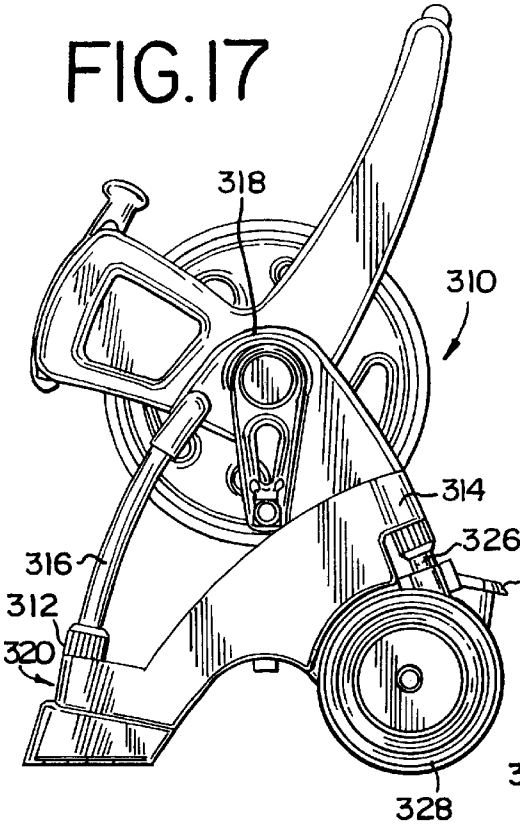
FIG. 17 is a side view of the cart of FIG. 16 as viewed from the right hand side thereof.

The alternate embodiment of the cart 310 further includes a steel U-shaped rear lateral beam 326. The rear beam 326 extends between and connects the side frame members 314 rearward of the axis of rotation of the wheels 328. Both the front steel support members 316 and the rear lateral beam 326 can be secured to the side frames 314 by a threaded compression fitting 330, an example of which is illustrated in FIG. 20. The compression fitting 330 includes a threaded sleeve 332 that extends from the molded portion of the frame 314 and is adapted to receive the respective steel members 316, 326. The sleeve 332 includes slots 334 that permit radial compression of the sleeve 332. A threaded collar or ring 336 having an inwardly inclined surface 338 threadedly engages the sleeve 332. As the collar 336 is threaded onto the sleeve 332, the inclined surface 338 compresses the sleeve 332 around and onto the steel member 316, 326 to secure the member 316, 326 within the fitting 330.

Optionally, this embodiment of the cart 310 can include a rear-mounted receptacle such as the illustrated bin 340, mounted to the cart 310 at the rear lateral beam 326. The rear-mounted bin 340 provides additional storage space for hose attachments and the like. Advantageously, the rear-mounted bin 340 can be used for permanent storage of such accessories.

As will be appreciated by those skilled in the art from a study of the figures and the above description, the carts 10, 210, 310 are formed primarily from molded components. In a present form, the carts 10, 210, 310 are formed primarily from high density polyethylene (HDPE) using an injection molding process. Those skilled in the art will recognize that there are various other materials that can be used to form the cart 10, 210, 310 components and various other processes by which the components can be made, which other materials and process are within the scope of the present invention.

From the foregoing, it will be observed that that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A portable hose reel cart having a folding handle pivotable between an in-use position and a storage position comprising:

a pair of spaced apart side frames members, the frame members having a base portion, each side frame including an inwardly extending stub;

a rotatable spool positioned between the side frames and operably connected thereto for rotation of the spool about an axis of rotation;

a folding handle assembly having a pair of spaced apart mounting arms and a gripping portion extending between the mounting arms, each of the mounting arms associated with a respective one of the side frame members, the spool being positioned intermediate the mounting arms, the handle assembly being pivotable relative to the side frame members between a storage position wherein the handle is rotated so that the gripping portion lies adjacent the base portion and an in-use position wherein the gripping portion is rotated away from the base portions and is spaced therefrom, each of the mounting arms including an open collar portion for receiving the stub from its respective side frame, the collar portions and stubs each including openings therein that align with one another when the handle is in the in-use position; and a lock assembly positioned in each of the handle assembly mounting arms, each lock assembly including a latch received in the mounting arm, each latch including a projection moveable between an engaged position wherein each projection engages its respective side frame and a disengaged position wherein each projection is disengaged from its respective side frame, each latch including a release button extending through an opening defined in an outer wall of its respective mounting arm, wherein the collar and stub openings align with one another when the handle is in the in-use position for receiving their respective latch projections.

2. The portable hose reel cart in accordance with claim 1 wherein each latch includes a biasing element to bias its projection into the engaged position.

3. The portable hose reel cart in accordance with claim 2 wherein the biasing element is formed integral with the latch.

4. The portable hose reel cart in accordance with claim 1 including wheels mounted to the cart at the base portion, each wheel being mounted to the cart independently of the other of the wheels.

5. The portable hose reel cart in accordance with claim 4 wherein the wheels are mounted generally vertically below the handle gripping portion when the handle assembly is in the in-use position.

6. The portable hose reel cart in accordance with claim 5 wherein the side frames each include an outwardly extending hub adapted to receive a wheel.

7. The portable hose reel cart in accordance with claim 6 including a wheel locking member having a plate and a stub extending therefrom, the stub adapted for receipt in the hub so that the plate abuts the wheel to secure the wheel to the side frame.

8. A portable hose reel cart having a folding handle pivotable between an in-use position and a storage position comprising:

a pair of spaced apart side frames members, the frame members having a base portion;

a rotatable spool positioned between the side frames and operably connected thereto for rotation of the spool about an axis of rotation;

a folding handle assembly having a pair of spaced apart mounting arms and a gripping portion extending between the mounting arms, each of the mounting arms associated with a respective one of the side frame members, the spool being positioned intermediate the mounting arms, the handle assembly being pivotable relative to the side frame members between a storage position wherein the handle is rotated so that the gripping portion lies adjacent the base portions and an in-use position wherein the gripping portion is rotated away from the base portions and is spaced therefrom;

a pair of wheels mounted to the cart at the base portion, the wheels being mounted to the cart independently of one another and generally vertically below the handle gripping portion when the handle assembly is in the in-use position, wherein each side frame includes an outwardly extending hub adapted to receive one of the wheels and a wheel locking member having a plate and a stub extending therefrom adapted for receipt in the hub so that when the wheel is positioned intermediate the plate and the side frame, the plate abuts the wheel to secure the wheel to the side frame; and a rear lateral support extending between and connecting the side frames at about the base portions thereof, wherein the stubs insert through at least a portion of the rear lateral support.

9. The portable hose reel cart in accordance with claim 8 wherein the rear lateral support includes a locking projection received by the side frames and wherein each stub inserts through a respective locking projection.

10. A portable hose reel cart having a folding handle pivotable between an in-use position and a storage position comprising:

a pair of spaced apart side frames members, the frame members having a base portion;

a rotatable spool positioned between the side frames and operably connected thereto for rotation of the spool about an axis of rotation;

a folding handle assembly having a pair of spaced apart mounting arms and a connecting member extending between the mounting arms, each of the mounting arms associated with a respective one of the side frame members, the spool being positioned intermediate the mounting arms, the handle assembly being pivotable relative to the side frame members between a storage position wherein the handle is rotated so that the connecting member lies adjacent the base portions of the side frames and an in-use position wherein the connecting member is rotated away from the base portions and is spaced therefrom;

a lock assembly positioned in each of the handle assembly mounting arms, each lock assembly including a latch received in the mounting arm, each latch including a latch projection moveable between an engaged position wherein each latch projection engages its respective side frame and a disengaged position wherein each latch projection is disengaged from its respective side frame; and a pair of wheels mounted to the cart at the base portion, each wheel being mounted to the cart independently of the other of the wheels, and being mounted generally vertically below the handle connecting member, wherein each side frame includes an outwardly extending hub adapted to receive one of the wheels, and including a wheel locking member having a plate and a stub extending therefrom, the stub adapted for receipt in the hub so that when the wheel is positioned intermediate the plate and the side frame, the plate abuts the wheel to secure the wheel to the side frame; and a rear lateral support extending between and connecting the side frames at about the base portions thereof, wherein the stub inserts through at least a potion of the rear lateral support.

11. The portable hose reel cart in accordance with claim 10 wherein the rear lateral support includes a locking projection at each end thereof, the locking projections being received by their respective side frames and wherein each stub inserts through its respective locking projection.

12. The portable hose reel cart in accordance with claim 10, wherein the latch projections each engage their respective side frames to lock the handle into the in-use position and wherein the latches each include a biasing element formed integral with the latch to bias the latch projections into the engaged position.

13. The portable hose reel cart in accordance with claim 12 wherein each latch includes a release button extending through an opening defined in an outer wall of its respective mounting arm.

* * * * *